United States Patent [19]

Eber

[11] 4,296,613

[45] Oct. 27, 1981

[54] ABSORPTION REFRIGERATOR

[76] Inventor: Nicholas Eber, CH-1830 Unterenqstringen, Switzerland

[21] Appl. No.: 82,929

[22] Filed: Oct. 9, 1979

[30] Foreign Application Priority Data

Oct. 18, 1978 [CH] Switzerland ..... 10763/78

[51] Int. Cl.[3] ..... F25B 39/02; F25F 1/30

[52] U.S. Cl. ..... 62/515; 165/182

[58] Field of Search ..... 62/442, 448, 453, 449, 62/515, 519, 523, 516, 517, 518, 298, 299; 165/162, 178, 181, 182, 183, 184

[56] References Cited

U.S. PATENT DOCUMENTS 3,587,242 6/1971 Asher et al. ..... 62/449 X

FOREIGN PATENT DOCUMENTS 1007899 10/1965 United Kingdom ..... 165/182

1220792 1/1971 United Kingdom ..... 165/182

*Primary Examiner*—Lloyd L. King

*Attorney, Agent, or Firm*—Kenyon & Kenyon

[57] ABSTRACT

In order to increase the space utilization and the efficiency of refrigeration in absorption refrigerators a finned body is placed about the evaporator. This finned body consists of a base plate and of cooling fins connected therewith. The base plate lies parallel to a wall of the refrigerator and has a convexly curved section directed toward the space to be refrigerated, into which fits the horizontal or slightly inclined evaporator tube of the refrigeration unit. Above and or below the curved section, cooling fins are connected with the base plate in heat-conductive relation to extend into the space to be refrigerated. The configuration of the ribbed body favors convective heat transfer. Also, the evaporator tube does not require additional space or depth, because it lies within the finned body cross section.

14 Claims, 3 Drawing Figures

ABSORPTION REFRIGERATOR

This invention relates to an absorption refrigerator. More particularly, this invention relates to a mounting means for an evaporator tube of an absorption refrigerator.

As is known, absorption refrigerators generally consist of a heat-insulated box and an absorption refrigeration unit which has a pressure-equalizing auxiliary gas serving to cool the interior of the box. Absorption refrigerators have some advantages over compressor refrigerators with which they often compete but also have some disadvantages. One of these disadvantages is due to the fact that from a certain box volume on, the space requirement of the absorption refrigerator is greater than that of the compressor refrigerator at equal useful volume. In part, this is system related since the absorption refrigeration unit is operated with heat energy and therefore, in principle, in addition to the function of a compressor refrigeration unit, the function of a heat power plant must be performed.

Moreover, secondary design-related factors have led to an enlargement of the unusable space requirement in absorption refrigerators, particularly in two-temperature refrigerators with a separate insulated freezer compartment. Usually, the regular refrigeration compartment operates at a temperature of about 5° C. and is refrigerated by natural convection. This convection results from the fact that the air comes in contact with the evaporator or with cooling ribs or fins which serve to enlarge the surface of the evaporator. In modern refrigerators, it has become normal practice not to form fins on the evaporator tube itself but to secure a finned body of good heat conductor material to the evaporator tube which extends parallel to the rear wall of the refrigerator either inside or outside the insulation. Such finned bodies essentially comprise a flat base plate and the cooling fins are substantially vertical. In these cases, the evaporator tube of the refrigeration unit is usually pressed against the base plate by a suitable means. The resulting contact area between the base plate and the normally circular evaporator tube is, thus, merely linear for example as shown in U.s. Pat. No. 3,587,242. As the cold evaporator tube must be well insulated toward the outside, this mode of construction requires a depth, in addition to the depth of the finned body or of the fins corresponding to the diameter of the evaporator tube. This is in the practice 15 to 23 millimeters (mm).

Another disadvantage of the absorption refrigerators has been that, due to the heat conduction-related temperature difference, the cooling fins are coldest at the level of the evaporator tube and, therefore, the air flowing along the cooling fins in a downward direction can no longer be cooled effectively enough by the finned lengths lying below the evaporator tube. Also, due to an increasing boundary layer, the heat transfer decreases along the cooling fins, and this the more as the fin dimension parallel to the flow direction increases. The result of these effects is that, as a whole, a larger cooling fin area is required for the transfer of the required refrigeration output and thereby the finned body requires still more space and its manufacture becomes more expensive.

Another disadvantage in the mode of construction common today is that, generally, the evaporator tube is exposed to air moisture condensation and consequently must be provided with high-grade and relatively expensive corrosion protection.

Briefly, the invention is directed to an absorption refrigerator comprised of a heat-insulated box having a wall with a layer of insulation therein and an absorption refrigeration unit having an evaporator tube for passage of a refrigerant therethrough. The refrigerator is provided with at least one finned body having a base plate mounted on the wall and defining a convexly curved section directed towards the interior of the box and receiving the evaporator tube in heat conductive relation. In addition, the finned body has a plurality of vertically disposed cooling fins mounted on the plate in heat conductive relation therewith.

The evaporator tube is horizontally disposed or slightly inclined to the horizontal while the cooling fins are disposed on opposite sides of the convexly curved section and are directed into the interior of the box. Due to the convexity of the base plate, the cooling fins are interrupted or at least substantially tapered at the level of the evaporator tube. This arrangement provides the following five advantages:

1. The evaporator tube requires no additional space for itself, since the tube lies inside the ribbed body contour;

2. The convexity of the finned body embraces the evaporator tube at least over half the tube circumference resulting in an advantageous area of contact;

3. The convexity of the finned body creates a secondary air flow along the fins below the convexly curved section which is directed upward, that is, the same as with the fins lying above the curved section, toward the coldest point of the finned body and is, hence, more effective;

4. The convectional flow along the fins is interrupted or disturbed by the convexly curved section whereby a better heat transfer is obtained and the heat transfer area can be made smaller;

5. The evaporator tube can easily be shielded from air moisture condensation in the convexity of the finned body and therefore does not require a high-grade and expensive corrosion protection.

These and other objects and advantages of the invention will become more apparent from the following detailed description and appended claims taken in conjunction with the accompanying drawings in which:

Figure 1:
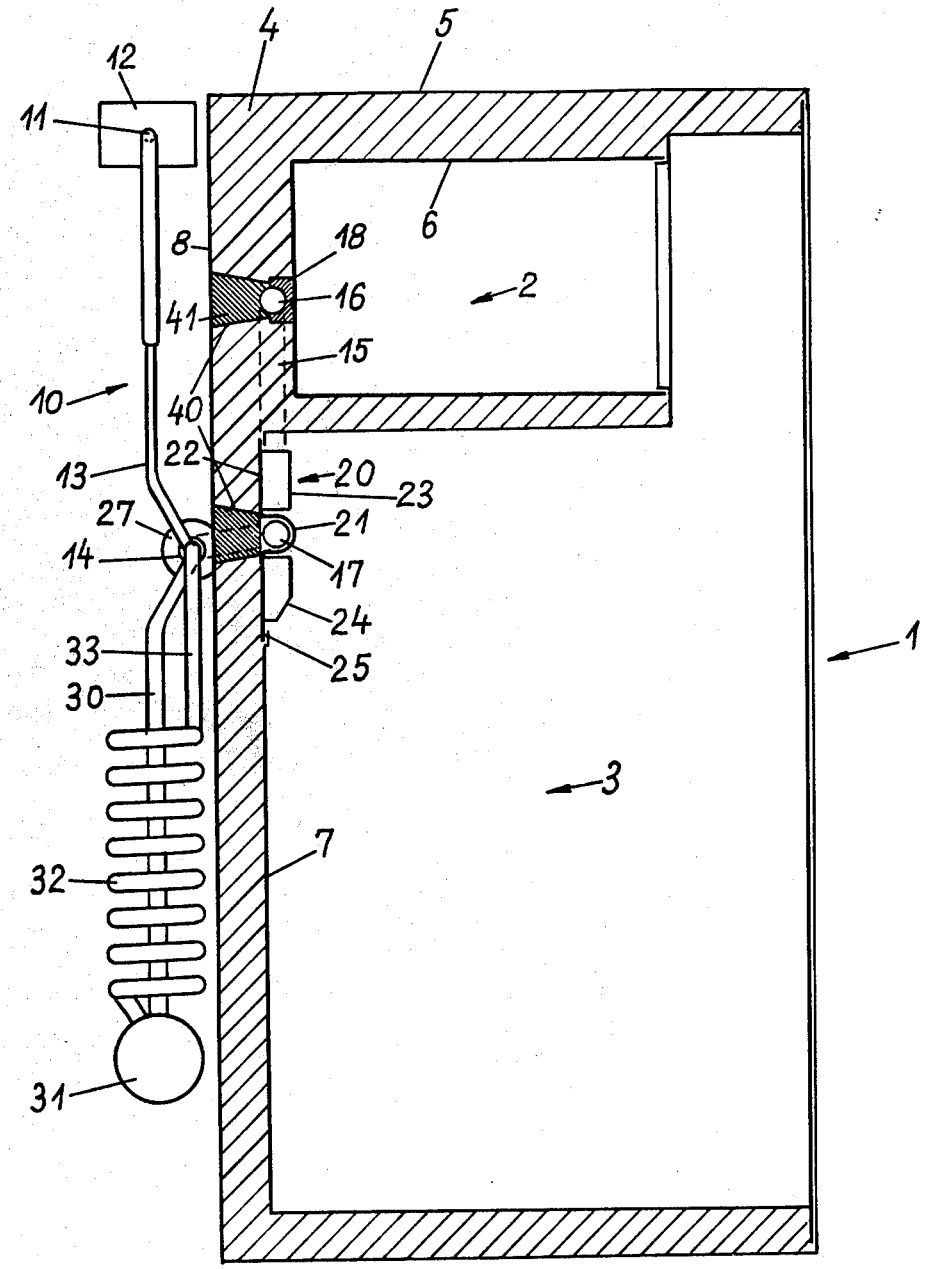
FIG. 1 illustrates a cross-sectional view of an absorption refrigerator constructed in accordance with the invention with a freezer compartment located at the top.

Referring to FIG. 1, the two-temperature absorption refrigerator 1 has a heat-insulated box containing a freezer compartment 2 and a regular refrigeration compartment 3. The refrigerator 1 is protected against heat inleak from the outside by a layer of insulation 4 which consists of a suitable heat insulation material, e.g. hard polyurethane foam. The freezer compartment 2 is further insulated from the regular compartment 3. The insulation 4 lies between an outer shell 5 and inner shells 6, 7 while the inner shell 6 of the freezer compartment 2 is made of good heat conductor material, e.g. aluminum sheet. The inner shell 7 of the regular compartment 3 need not be a good heat conductor and is therefore normally made of plastic.

An absorption refrigeration unit 10 lies behind a back wall 8 of the refrigerator 1 and is secured thereto. Only some principal components of the absorption refrigeration unit 10 are shown in FIG. 1 diagrammatically, as more is not needed to explain the invention. As indicated, the refrigeration unit 10 has a condenser 11 which is provided with cooling fins 12. In the condenser 11, a refrigerant vapor, expelled due to supply of heat in a heater (not shown) of the refrigeration unit 10 is liquefied by means of the cooling effect of the surrounding air. From the condenser 11, the liquid refrigerant passes through a refrigerant line 13 via a gas heat exchanger 14 into an evaporator 15, where the refrigerant evaporates with absorption of heat from the refrigerator. The evaporator 15 has a low-temperature portion 16 in the form of a tube which is connected with the good heat conductor inner shell 6 of the freezer compartment 2 and a high-temperature portion 17 in the form of a horizontal tube which takes care of the refrigeration for the regular compartment 3.

A finned body 20 is provided to function as a surface enlarging means for the evaporator tube 17. The finned body 20 is made of a good heat conductor and corrosion resistant material, e.g. aluminum, and consists essentially of a base plate 22 which defines a protruding convexly curved section 21 and a plurality of vertically disposed cooling fins 23, 24 which are mounted on the plate 22 in heat conductive relation therewith. As illustrated, the fins 23, 24 are mounted in groups above and below the curved section 21 in spaced relation to define a gap, e.g. of at least three millimeters. The curved section 21 is sized so as to receive the high temperature tube 17 in heat conductive relation. The edge 25 of the base plate 22 of the finned body 20 is anchored in the insulation behind the inner shell 7 of the regular compartment 3. In this way, the high temperature tube 17 of the evaporator 15 is hermetically protected against corrosion due to condensation of air moisture from the refrigerated space.

The downward extension of the evaporator 15 is formed by the gas heat exchanger 14 in which a heat exchange takes place between the warm liquid refrigerant and warm auxiliary gas stream on the one hand and the cold auxiliary gas-refrigerant vapor mixture coming out of the evaporator 15. This heat exchange is very essential for the proper functioning of the refrigeration unit 10. The temperature of the gas heat exchanger 14 lies for the most part between the temperature of the surrounding and of the regular compartment 3 and therefore must be insulated against both. For this reason, the gas heat exchanger 14 is often placed in the rear wall insulation of the refrigerator. But as this requires much additional space and complicates installation and removal of the refrigeration unit, the heat exchanger 14 extends into the space behind the rear wall 8 of the refrigerator and is provided in the example shown with a separate insulation 27. The insulation 27 for the gas heat exchanger 14 may be an insulation hose of porous and elastic material which before installation of the refrigeration unit 10 is pulled over the open upper end of the evaporator 15 and pushed over the gas heat exchanger 14.

The gas heat exchanger 14 is connected by a tube 30 with a solution container 31 and the latter, in turn, with an absorber tube coil 32. The refrigerant-laden gas mixture flows out of the gas heat exchanger 14 through the tube 30 and solvent container 31 into the absorber tube coil 32. The auxiliary gas is depleted of refrigerant in the coil 32 and passes through the connecting line 33 and gas heat exchanger 14 into the evaporator 15. The insulation 4 of the refrigerator has slots or slit type cutouts 40 toward the back which permit the installation and/or removal of the evaporator 15 and, hence, the refrigeration unit 10. After installation of the refrigeration unit 10 or introduction of the evaporator 15 through the cutouts 40, the cutouts 40 are tightly closed against the outside by means of the wedge-shaped closure plugs 41, also made of insulating material. In order to improve the heat transfer between the low-temperature tube 16 and the inner shell 6 of the freezer compartment 2, a sectional bar 18 made of good heat conductor material is interposed between the evaporator tube 16 and shell 6. The sectional bar 18 has a flat side, turned toward the inner shell 6 of the freezer compartment 2, and a semicircular cutout which offers a large contact area for the evaporator tube 16 lying therein. Since the primary air current, which is cooled upon flowing along and between the fins of the upper row of fins 23, is displaced by the curved section 21 of the finned body 20 toward the interior of the regular compartment 3, a secondary air flow is created which is directed upward along the lower row of fins 24 and combines with the primary air flow below the curved section 21, cooling more and more. Ideal heat transfer conditions are thus obtained, since the air always flows in the direction toward the coldest point of the finned body 20, namely the curved section 21 or, respectively, the evaporator tube 17.

Figure 2:
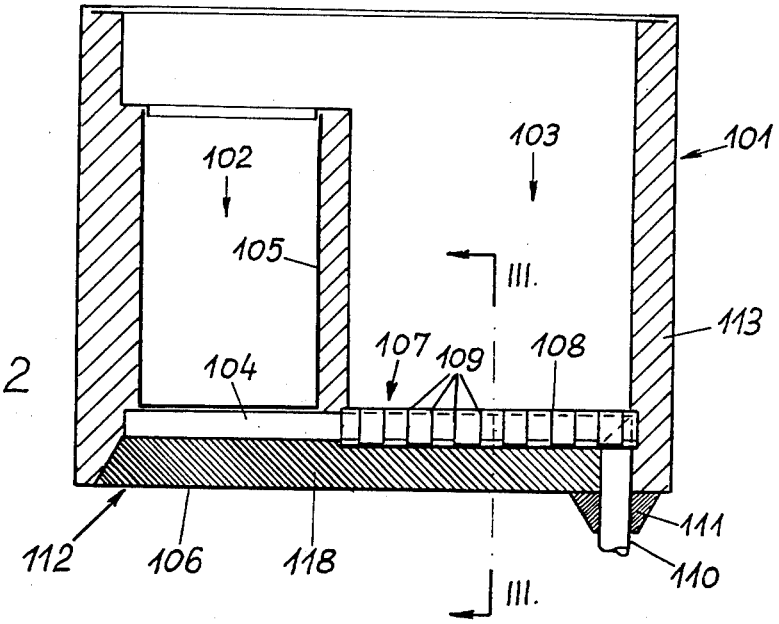
FIG. 2 illustrates an absorption refrigerator in accordance with the invention with a freezer compartment disposed on the side.

Referring to FIG. 2, as a further example, the absorption refrigerator may be constructed as a two-temperature refrigerator 101 in which a freezer compartment 102 is disposed on the side and occupies a portion of the width of the refrigerator. The regular refrigeration compartment 103 is next to and below the freezer compartment 102. In this case, an evaporator tube 104 of the absorption refrigeration unit (not shown) lies parallel to the rear wall 106 of the refrigerator and is in contact with an inner shell 105, made of good heat conductor material, of the freezer. The rest or extension of the evaporator tube, which functions as a high-temperature evaporator, lies in a convexly curved section 108 of a finned body 107 as above. The finned body 107 is made of good heat conductor material and also carries cooling fins 109 which project with the curved section 108 toward the interior of the refrigerator. A tube section 110 contiguous and at right angles to the evaporator 104 contains the gas heat exchanger (not shown). The tube section 110 is surrounded by a part 11 made of insulating material. A wedge 118 of insulating material closes a slit 112 in the rear wall insulation, through which the evaporator 104 can be installed and removed. The edge of the finned body 107 is anchored in the insulation 113.

Figure 3:
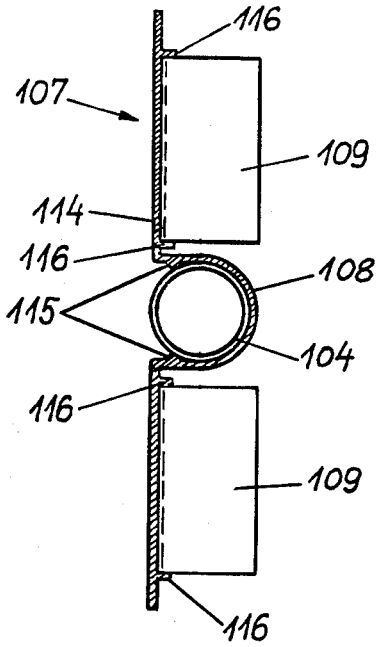
FIG. 3 illustrates a transverse section along line III—III in FIG. 2.

Referring to FIG. 3, the base plate 114 of the finned body 107 consists of an extruded aluminum section and has two webs or cams 115 on the inside of the convexly curved section 108 for retention of the evaporator tube 104. During installation of the refrigeration unit, the webs 115 are temporarily pressed apart elastically by the evaporator tube 104. On the front side of the base plate 114 are four webs 116 which, being bent down at intervals, serve to retain the cooling fins 109. Alternatively, of course, the finned body 107 may be produced and assembled by other desired methods, such as casting, gluing, soldering, welding, riveting, screwing.

What is claimed is:

1. An absorption refrigerator comprising a heat-insulated box having a wall and a layer of insulation therein;

an absorption refrigeration unit having an evaporator tube for passage of a refrigerant therethrough; and at least one finned body having a base plate mounted on said wall and defining a convexly curved section receiving said evaporator tube in heat-conductive relation and a plurality of vertically disposed cooling fins mounted on said plate in heat-conductive relation therewith and in spaced vertical relation to said curved section to define a gap, said curved section and said fins being directed towards the interior of said box.

2. An absorption refrigerator as set forth in claim 1 wherein said evaporator tube is horizontally disposed.

3. An absorption refrigerator as set forth in claim 2 wherein said fins are disposed on opposite sides of said convexly curved section.

4. An absorption refrigerator as set forth in claim 1 wherein said gap is at least three millimeters.

5. An absorption refrigerator as set forth in claim 1 wherein said fins extend from said plate a distance equal to the projection of said curved section from said base plate.

6. An absorption refrigerator as set forth in claim 1 wherein said base plate has an edge anchored in said insulation.

7. An absorption refrigerator as set forth in claim 1 wherein said curved section embraces said evaporator tube over an angle of more than 180°.

8. An absorption refrigerator as set forth in claim 1 which further comprises a plurality of cams on said plate on opposite sides of said curved section to hold said evaporator tube therein.

9. An absorption refrigerator as set forth in claim 1 wherein said insulation has slots for passage of said evaporator tube therethrough and plugs of insulating material for plugging said slots.

10. An absorption refrigerator as set forth in claim 1 wherein said refrigeration unit has a gas heat exchanger outside said wall and a porous elastic hose insulating said heat exchanger.

11. A surface-enlarging means for an evaporator tube of an absorption refrigeration unit, said means including a base plate defining a convexly curved section for receiving an evaporator tube and a plurality of cooling fins mounted on opposite sides of said curved section of said plate in heat-conductive relation therewith and in spaced apart perpendicular relation to said curved section to define a gap with said curved section.

12. An absorption refrigerator comprising a heat-insulated box having a wall and a layer of insulation therein;

an absorption refrigeration unit having an evaporator tube for passage of a refrigerant therethrough; and at least one finned body having a base plate mounted on said wall and defining an intermediately disposed convexly curved section receiving said evaporator tube in heat-conductive relation and a plurality of vertically disposed cooling fins mounted on said plate in heat-conductive relation therewith and disposed on opposite sides of said curved section in spaced vertical relation to said evaporator tube, said curved section and said ribs being directed towards the interior of said box.

13. An absorption refrigerator as set forth in claim 12 wherein said fins extend from said plate a distance equal to the projection of said curved section from said base plate and said curved section embraces said evaporator tube over an angle of more than 180°.

14. An absorption refrigerator comprising a heat-insulated box having a wall and a layer of insulation therein;

an absorption refrigeration unit having an evaporator tube for passage of a refrigerant therethrough; and at least one finned body having a base plate mounted on said wall and defining a convexly curved section receiving said evaporator tube in heat-conductive relation and a plurality of cooling fins mounted on said plate in heat-conductive relation therewith to direct an air current flowing along and between said fins towards said curved section, said curved section and said fins being directed towards the interior of said box.

* * * * *

UNITED STATES PATENT AND TRADEMARK OFFICE

CERTIFICATE OF CORRECTION

PATENT NO. : 4,296,613

DATED : October 27, 1981

INVENTOR(S) : NICHOLAS EBER

It is certified that error appears in the above—identified patent and that said Letters Patent is hereby corrected as shown below:

In the Abstract - Line 12, change "ribbed" to --finned--

Column 1, line 44, change "U.s." to --U.S.--

Column 1, line 48, after "fins" insert --,--

Column 2, line 24, change "ribbed" to --finned--

Signed and Sealed this

*Thirteenth* Day of *April 1982*

[SEAL]

*Attest:*

GERALD J. MOSSINGHOFF

*Attesting Officer*

*Commissioner of Patents and Trademarks*